US006857735B2

(12) United States Patent
Furukawa

(10) Patent No.: US 6,857,735 B2
(45) Date of Patent: Feb. 22, 2005

(54) METHOD FOR TRANSFERRING A COLOR IMAGE

(76) Inventor: Ken-ichi Furukawa, 1-11-13, Yukarigaoka, Sakura-shi, CHIBA 285-0858 (JP)

( * ) Notice: Subject to any disclaimer, the term of this patent is extended or adjusted under 35 U.S.C. 154(b) by 47 days.

(21) Appl. No.: 10/425,367

(22) Filed: Apr. 29, 2003

(65) Prior Publication Data

US 2004/0218028 A1 Nov. 4, 2004

(51) Int. Cl.[7] ..... B41J 2/01
(52) U.S. Cl. ..... 347/103; 347/101
(58) Field of Search ..... 347/101, 103, 347/100, 95, 96, 171, 172; 430/325, 252

(56) References Cited

U.S. PATENT DOCUMENTS 5,369,421 A * 11/1994 Tomono et al. ..... 347/172
5,534,387 A * 7/1996 Bodager et al. ..... 430/325
6,339,442 B1 * 1/2002 Miyamoto et al. ..... 347/171
6,439,713 B1 * 8/2002 Noguchi et al. ..... 347/103
6,561,645 B2 * 5/2003 Miyamoto ..... 347/103

* cited by examiner

*Primary Examiner*—Manish Shah
(74) *Attorney, Agent, or Firm*—Dennis G. LaPointe; Mason Law, P.L.

(57) ABSTRACT

A color image transfer method includes performing solid printing of an image portion on a hydrophilic transfer sheet coated with a water-soluble resin with an aqueous solution ink containing a component that dissolves the resin and imparts the resin with an adhesive property for a desired time by use of an ink jet printer, scattering heat-bondable resin powder onto the solid printed portion and fixing it thereto while removing the powder from portions other than the image portion, printing with a sublimation ink so that the image may be in register with the solid-printed image, superimposing the image surface on an article to be transferred and heat pressing, and peeling off the transfer sheet from the article to be transferred by giving moisture to the transfer sheet. The method enables single-part production of articles for full color image printing and can transfer only an image portion as in screen printing.

8 Claims, No Drawings

METHOD FOR TRANSFERRING A COLOR IMAGE

FIELD OF THE INVENTION

The present invention relates to a method for transferring a color image. More particularly, the present invention relates to a method for transferring a color image in which only an image portion that is formed from a heat-bondable resin powder and a sublimating dye on a transfer sheet is transferred onto an article to be transferred.

DESCRIPTION OF THE BACKGROUND ART

Printing an image on a fabric is generally performed by screen printing. In addition, where support for full color printing is necessary, it is conducted by a thermal transfer method using a color laser printer. In this method, a transfer paper made of a releasable paper having laminated thereon a heat-bondable resin layer on which a toner image is formed by use of a color laser printer, is brought into close contact with a fabric, followed by heating, thereby heat-bonding the resin layer holding the color image to the fabric.

The above-mentioned screen printing indispensably requires screen plate-making and toning so that it is unsuitable for orders of small lots and for orders with short delivery times. Furthermore, in the methods using a color laser printer, the entire surface including portions having no image, of the heat-bondable resin layer on the transfer paper, adheres to the fabric, so that it is impossible to transfer only a part that bears a design to be printed such as characters and logo marks as a sharp image onto the fabric.

SUMMARY OF THE INVENTION

Therefore, an object of the present invention is to provide a method for transferring a color image that enables single-part production and full color image printing and that can transfer only an image portion as in screen printing.

As a result of extensive studies, the inventor of the present invention has found that sublimation ink printing of an image free from bleeding can be achieved by the following steps:

according to a desired image information, performing printing on a transfer sheet (recording medium) made of a hydrophilic material having on a surface thereof an water-soluble resin layer with an aqueous solution containing a component other than water (aqueous solution ink) that dissolves the water-soluble resin to impart adhesive property for a certain period of time by use of an ink jet printer, then scattering heat-bondable resin powder onto the water-soluble resin portion showing lasting imagewise adhesiveness to fix the heat-bondable resin powder, and further on the fixed heat-bondable resin powder, printing an image by using a sublimation ink in register with the above-mentioned solid printed image by use of an ink jet printer.

The present inventors also have found that by superimposing the image thus formed on the transfer sheet on an article to be transferred and heat-pressing it, only image portion(s) of the heat-bondable resin powder layer dyed with the sublimating dye can be transferred to the article; and that giving moisture to the transfer sheet thereafter enables the transfer sheet to be readily peeled off, so that a sharp image can be transferred. The present invention has been accomplished based on these findings.

That is, the present invention relates to the following color image transfer methods.

1. A color image transfer method comprising:

performing solid printing of an image portion on a hydrophilic transfer sheet substrate having coated on a surface thereof a water-soluble resin with an aqueous solution (an aqueous solution ink) containing a component that imparts the water-soluble resin with an adhesive property for a certain period of time by use of an ink jet printer;

scattering heat-bondable resin powder onto the solid printed portion and fixing it thereto while removing the powder from portions other than the image portion;

printing a sublimation ink on the solid-printed image by use of an ink jet printer in register with the solid printed image;

superimposing the thus printed image surface on an article to be transferred and then heat-pressing it;

and peeling off the transfer sheet from the article to be transferred by giving moisture to the transfer sheet.

2. The color image transfer method as described in 1 above, wherein after printing with the sublimation ink, the transfer sheet having the heat-bondable resin powder image thereon with the sublimation ink being attached thereon is heated in advance to cause the sublimation ink to develop colors before superimposing the image surface on an article for the image to be transferred, heat-pressing to bond each other, and peeling off the transfer sheet by giving moisture.

3. The color image transfer method as described in 1 above, wherein the component that imparts an adhesive property to the water-soluble resin for a certain period of time is at least one member selected from the group consisting of polyhydric alcohols and polyalkylene glycols.

4. The color image transfer method as described in 1 above, wherein the water-soluble resin is used in combination with a component that imparts the water-soluble resin with an adhesive property for about 1 minute or longer.

5. The color image transfer method as described in 1 above, wherein the heat-bondable resin powder has an average particle diameter of about 5 to 100 $\mu$m.

6. The color image transfer method as described in 1 above, wherein the hydrophilic transfer sheet substrate is made of a material comprising paper or a synthetic paper having a hydrophilic functional group.

7. The color image transfer method as described in 1 above, wherein the article to be transferred is bondable to the heat-bondable resin.

8. The color image transfer method as described in 1 above, wherein the article to be transferred is selected from the group consisting of paper, cardboard, metallic materials, wood materials, hide materials, glass, ceramics, plastic moldings and plastic films.

DETAILED DESCRIPTION OF THE INVENTION

In the color image transfer method according to the present invention, first, on a transfer sheet (transfer paper) having laminated thereon a water-soluble resin that serves as a substrate is performed solid printing corresponding to desired image information with an aqueous solution containing a component other than water that dissolves the water-soluble resin and imparts adhesive property for a certain period of time by use of an ink jet printer. This printing is performed only on an image portion. That is, in the case of image of characters or words, only the character region is printed. On the other hand, in the case of full color image, the entire image region is subjected to solid printing. Furthermore, the printing, with the aqueous solution ink is preferably performed at a size slightly greater as needed, for example, by 1 to 2 mm greater than the outline of the image information portion, in order to assimilate printing overlaps between the printing with aqueous solution ink and a subsequent printing with a sublimation ink.

Then, a heat-bondable resin powder is scattered onto the water-soluble resin portion that exhibits imagewise lasting adhesiveness, a sublimation ink is printed onto the heat-bondable resin powder so that the image can be in register with the solid-printed image by use of an ink jet printer, and the image on thus printed transfer paper which the sublimation ink is adhered to is transferred onto an article for the image to be transferred, for example, a fabric, by the following procedure.

First, the printed transfer paper is superimposed on the fabric and is heat pressed to bond to each other. This results in melting of the heat-bondable resin powder on the transfer paper to adhere to the fabric. At the same time, the heat allows the sublimation ink adhered to the heat-bondable resin powder to develop colors, thereby dyeing the resin derived from the powder now rendered adhesive. Then, moisture is given to the transfer paper from the backside thereof. This leads to dissolution of the water-soluble resin, which enables the transfer paper to be smoothly released from the fabric. As a result, a fabric with a desired color image firmly fixed thereon with the heat-bondable resin can be obtained.

On this occasion, the temperature of heat pressing, which may vary depending on the softening temperature of the heat-bondable resin powder used, is generally 150 to 180° C., and the heating time is generally 20 to 40 seconds.

Generally, the ink discharged from an ink jet printer causes a problem that the ink spreads onto a peripheral portion, and that, in the case of color image, four color inks are mixed with each other, unless an ink receiver surface is previously arranged to rapidly absorb ink. For this purpose, steps such as coating the ink receiver surface with a water-soluble resin that can readily absorb ink and blending a large amount of porous extender therewith is performed. However, a major feature of the present invention is that the heat-bondable resin powder is fixed by relying on the adhesive property of the water-soluble resin, and hence the heat-bondable resin, while it has no ink absorbability itself, can receive ink at a high resolution due to its huge surface area which allows the ink to be absorbed as wet on the powder surface even in the case using color ink where the ink is usually discharged in large amounts.

In addition, another major feature of the present invention is that since the heat-bondable resin powder is temporarily fixed on the water-soluble resin, the transfer paper can be easily released by giving moisture to the transfer paper after it is superimposed and heat-pressed onto the article for the image to be transferred.

Although the present invention has been described with respect to the cases where images are dyed onto fabrics used as articles to be transferred, it would be apparent to one skilled in the art that the present invention is a technology that can be applied to any material such as paper, cardboard, metallic materials, wood materials, hide materials, glass, ceramics, and plastic moldings and films as far as heat-bondable resins can be bonded thereto.

Moreover, the color development of the sublimation ink attached to heat-bondable resin powder does not necessarily have to be performed by the above-mentioned heat in the step of heat-pressing the transfer paper and the article to be transferred (fabric). Instead, transfer maybe performed after completion of color development through a method in which a transfer sheet having a powder image with sublimation ink attached thereto is previously heated without contact, for example, by leaving the transfer sheet on a hot plate or in a heating furnace, or by blowing hot air to the transfer sheet and then the transfer sheet is superimposed and heat-pressed onto an article to be transferred. Such a non-contact color development performed in advance increases color fastness. This is because among the components of the sublimation ink attached to the heat-bondable resin powder, high-boiling solvents such as glycerol can be eliminated during the prior heating process, so that the adhesive strength between the heat-bondable resin and the article to be transferred in the heat-pressing step can be increased. In addition, in such a case where color is developed by previous heating, conditions for the heat-pressing step may be adjusted in consideration of only heat-bondable property of the heat-bondable resin powder, which makes it possible to complete the transfer at lower temperatures in a shorter period of time. This is very effective in the case where the article to be transferred is of a material having poor heat resistance, such as leather; color development by previous heating enables heat pressing transfer under conditions of 100 to 130° C. for 10 seconds or less.

In the present invention, since the transfer sheet substrate is to be given water in a subsequent step to dissolve the water-soluble resin so that the dissolved powder attached to the article to be transferred can be peeled off, hydrophilic substrates having the property of smoothly permeating water, for example, paper and those substrates that are based on synthetic paper having hydrophilic functional groups are used. In particular, no-sizing paper is preferable.

In the present invention, the water-soluble resin that is coated on the surface of a hydrophilic transfer sheet substrate includes natural polymers and synthetic polymers.

Examples of the natural polymer include starch such as dextrin, seaweed materials such as sodium alginate, plant mucous substances such as gum Arabic, mucous substances produced by microbes, such as dextran, and proteins such as gelatin. Examples of the synthetic polymer include viscose, methyl cellulose, ethyl cellulose, hydroxyethyl cellulose, carboxymethyl cellulose, carboxymetyl starch, dialdehyde starch, polyvinyl alcohol, sodium polyacrylate, and polyethylene oxide. These, either singly or as mixtures, are laminated on a substrate to a thickness of 1 to 50 $\mu$m, generally 2 to 20 $\mu$m, by a method for coating a polymer solution in a conventional manner.

Note that in order to improve the ink absorbability, extenders such as calcium carbonate and silica maybe compounded.

In the present invention, the water-soluble resin to be coated on the surface of a transfer sheet substrate naturally has solubility in water and swells when water droplets are attached thereto to exhibit adhesiveness. However, with only water, even if swelling once occurs to exhibit adhesiveness, the surface is dried within a very short time of ten and several seconds due to the compatibility of water to the water-soluble resin, resulting in that an operation of powder scattering in a subsequent step cannot be performed stably. Accordingly, in the present invention, a component that imparts adhesive property to the water-soluble resin for a longer time is used together with water. Examples of such a component include polyhydric alcohols and polyalkylene glycols.

By combination use of water-soluble resins and polyhydric alcohols or polyalkylene glycols, adhesiveness of water-soluble resin can last for 1 minute or longer, preferably 3 minutes or longer, more preferably 5 minutes or longer as is necessary for carrying out the method of the present invention.

Examples of the polyhydric alcohols and polyalkylene glycols that can be used in the present invention include those having medium boiling points (120 to 230° C.) such as ethylene glycol and propylene glycol, and those having high boiling points (230 to 320° C.) such as diethylene glycol, triethylene glycol and dipropylene glycol. The glycol content required for realizing a stable swollen state lasting for 10 minutes or longer is preferably about 50% or more in the case of the medium-boiling glycol alone, or about 20% or more in the case of high-boiling glycol alone. In the case of mixtures of the both, the above-mentioned glycol content is preferably about 40% or more depending on the mixing ratio. However, in a case where adhesiveness lasting for a shorter time is sufficient, the glycol content may be decreased.

The sublimation dyes used in the present invention may be any dye that has a property of sublimating or vaporizing and preferably are those dyes that sublimate or vaporize at 70 to 260° C. under the atmospheric pressure. Examples of such dyes include azo, anthraquinone, quinophthalone, styryl, di- or triphenylmethane, oxazine, triazine, xanthene, methyne, azomethyne, cyclidine, diazine and the like dyes having sublimation or vaporization property. In addition, examples of other dyes usable in the present invention include 1,4-diemthylaminoanthraquinone, 1,5-dihydroxy-4, 8-diaminoanthraquinone bromide or chloride, 1,4-diamino-2,3-dichloroanthraquinone, 1-aminohydroxyanthraquinone, 1-amino-4-hydroxy-2-(β-methoxy-ethoxy)anthraquinone 1-amino-4-hydroxy-2-phenoxyanthraquinone, methyl, ethyl, propyl or butyl ester of 1,4-diaminoanthraquinone-2-carboxylic acid, 1-amino-4-anilidoanthraquinone, 1-amino-2-cyano-4-anilido(or cyclohexylamino)anthraquinone, 1-hydroxy-2-(p-acetaminophenylazo)-4-methylbenzene, 3-methyl-4-(nitrophenylazo)pyrazolone, and 3-hydroxyquinophthalone. Examples of basic dyes that may be used include malachite green and methyl violet. Also, dyes modified with sodium acetate, sodium ethylate, sodium methylate or the like maybe used. As sublimation ink for ink jet printing containing a sublimation dye as a colorant, those commercially available as water-dispersion based ink which have a dye concentration of about 5% can be preferably used in the present invention.

As resin material for heat-bondable resin powder that can be used in the present invention, resin to which a sublimation dye can be stably fixed and may be selected as appropriate from generally used thermoplastic adhesives having adhesion temperature within the range of about 100 to 180° C. Examples thereof include polyvinyl acetate copolymers, polyvinyl alcohol, polyvinyl formal, polyvinyl butyral, acrylic adhesives, epoxy adhesives, urethane adhesives, ethylene/vinyl acetate copolymers, ethylene/vinyl alcohol copolymers, ethylene/ethyl acrylate copolymers, ethylene/acrylic acid copolymers, vinyl chloride/vinyl acetate copolymers, vinyl chloride/vinyl acetate/maleic anhydride terpolymers, polyvinyl ether, polyester resins and cellulose derivatives. These may be used singly or as mixtures, or a composition may be produced by compounding therein an ultraviolet absorbent depending on applications, for example, outer wear such as ski wear or advertisement display on a metal plate. The resins are used after formulating them into powder having an average particle diameter of about 5 to about 100 μm, generally about 20 to about 60 μm by a refrigeration pulverization method or a solution spraying method. Alternatively, polymers having average particle diameters within the above-mentioned range can be directly produced by an emulsification polymerization.

BEST MODE FOR CARRYING OUT THE INVENTION

Hereinafter, the present invention will be described in detail with reference to specific examples of the present invention. However, the present invention should not be considered to be limited to the following description.

EXAMPLE 1

Ethylene glycol (80 mass parts) and purified water (20 mass parts) were mixed to prepare an aqueous solution for an ink jet printer (aqueous solution ink). Then, genuine ink of a thermal type ink cartridge "HP51626A" (manufactured by HEWLETT PACKARD Company (U.S.A.)) was emptied and then filled with the above-mentioned aqueous solution ink. The filled ink cartridge was set in a ink jet printer NOVAJET III (trademark, manufactured by ENCAD Inc. (U.S.A.)) and by use of the printer, solid printing of an entire image was performed onto a transfer paper "SPA" (trademark, manufactured by Marushige Paperworks Co., Ltd.) on which dextrin was coated to a thickness of 5 μm. After about 1 minute, a saturated copolymer polyester resin powder (obtained by refrigerating "Chemit R248" (trade name, manufactured by Toray Corporation; molecular weight: 30,000, hardness 60 to 70, melting point: 113° C.) in liquid nitrogen (−192° C.) and pulverizing into powder (particle size distribution in terms of mesh passing percentage (wt %): 39.2% for passing a mesh of 45 μm or less and 96.2% for passing a mesh of 105 μm or less), was scattered on the obtained image, followed by removing excess powder from the transfer paper. Then, printing was performed by using a sublimation ink (manufactured by ECS Specialty Inks and Dyes (Switzerland)) so that the sublimation ink image is in register with the powder-attached image printed on the transfer paper by the previous solid printing. The transfer paper thus printed with the sublimation ink was superimposed on a fabric made of cotton and was heat-pressed at 170° C. for 30 seconds. Then, water was given to the backside of the transfer paper and after 30 seconds the transfer paper was peeled off from the fabric. As a result, obtained was a fabric to which the image was transferred with colors in high concentration only at the image portion and the image had excellent washing fastness.

EXAMPLE 2

Ethylene glycol (35 mass parts), diethylene glycol (15 mass parts), isopropyl alcohol (10 mass parts) and purified water (40 mass parts) were mixed to prepare an aqueous solution ink for an ink jet printer, and the aqueous solution ink was filled into an ink cartridge for a piezo ink jet printer PM-670C (manufactured by Seiko Epson Corp.), after previously emptying the cartridge by removing genuine ink. Thereafter, a transfer paper printed with a sublimation ink was obtained by the same procedure as in Example 1. The transfer paper thus printed with the sublimation ink was superimposed on an aluminum foil and was heat-pressed at 150° C. for 20 seconds. Then, water was given to the backside of the transfer paper and after 30 seconds the transfer paper was released. As a result, obtained was an aluminum foil to which the image had been transferred with colors in high concentration only at the image portion.

EXAMPLE 3

A transfer paper printed with a sublimation ink was obtained by the same procedure as in Example 1. After leaving the transfer paper printed with the sublimation ink in a heating furnace at 160° C. for 1 minute, the transfer paper was superimposed on a cowhide serving as an article to be transferred and was heat-pressed at 120° C. for 10 seconds. Then, water was given to the backside of the transfer paper and after 30 seconds the transfer paper was peeled off. As a result, obtained was a cowhide to which the image was transferred with colors in high concentration only at the image portion.

EXAMPLE 4

A transfer paper printed with a sublimation ink was obtained by the same procedure as in Example 1. After contacting the backside of the transfer paper with a hot roller at 160° C. for 30 seconds, the transfer paper was superimposed on a 50 μm-thick polyester film "Teijin Tetron Film S6" (trade name, manufactured by Teijin Corporation) and was heat-pressed at 150° C. for 15 seconds. Then, water was given to the backside of the transfer paper and after 30 seconds the transfer paper was released. As a result, obtained was a polyester film to which the image had been transferred with colors in high concentration only at the image portion.

INDUSTRIAL APPLICABILITY

According to the present invention, a method that can transfer only an image portion printed on a transfer sheet firmly onto an article to be transferred is provided. The method of the present invention enables single-part production of articles and transfer of sharp color images to articles including any desired substrate selected from a wide range of materials.

What is claimed is:

1. A color image transfer method comprising:

performing solid printing of an image portion on a hydrophilic transfer sheet substrate having coated on a surface thereof a water-soluble resin with an aqueous solution (an aqueous solution ink) containing a component that imparts the water-soluble resin with an adhesive property for a certain period of time by use of an ink jet printer;

scattering heat-bondable resin powder onto the solid printed portion and fixing it thereto while removing the powder from portions other than the image portion;

printing a sublimation ink on the solid-printed image by use of an ink jet printer in register with the solid printed image;

superimposing the thus printed image surface on an article to be transferred and then heat-pressing it;

and peeling off the transfer sheet from the article to be transferred by giving moisture to the transfer sheet.

2. The color image transfer method as claimed in claim 1, wherein after printing with the sublimation ink, the transfer sheet having the heat-bondable resin powder image thereon with the sublimation ink being attached thereon is heated in advance to cause the sublimation ink to develop colors before superimposing the image surface on an article for the image to be transferred, heat-pressing to bond to each other, and peeling off the transfer sheet by giving moisture.

3. The color image transfer method as claimed in claim 1, wherein the component that imparts an adhesive property to the water-soluble resin for a certain period of time is at least one member selected from the group consisting of polyhydric alcohols and polyalkylene glycols.

4. The color image transfer method as claimed in claim 1, wherein the water-soluble resin is used in combination with a component that imparts the water-soluble resin with an adhesive property for about 1 minute or longer.

5. The color image transfer method as claimed in claim 1, wherein the heat-bondable resin powder has an average particle diameter of about 5 to 100 μm.

6. The color image transfer method as claimed in claim 1, wherein the hydrophilic transfer sheet substrate is made of a material comprising paper or a synthetic paper having a hydrophilic functional group.

7. The color image transfer method as claimed in claim 1, wherein the article to be transferred is bondable to the heat-bondable resin.

8. The color image transfer method as claimed in claim 1, wherein the article to be transferred is selected from the group consisting of paper, cardboard, metallic materials, wood materials, hide materials, glass, ceramics, plastic moldings and plastic films.

* * * * *